US010905231B1

(12) United States Patent
Horowitz et al.

(10) Patent No.: US 10,905,231 B1
(45) Date of Patent: Feb. 2, 2021

(54) ADJUSTABLE-HEIGHT FOLDING TABLE

(71) Applicants: Brian Horowitz, Lake Forest, CA (US); Larry Tang, Lake Forest, CA (US)

(72) Inventors: Brian Horowitz, Lake Forest, CA (US); Larry Tang, Lake Forest, CA (US)

( * ) Notice: Subject to any disclaimer, the term of this patent is extended or adjusted under 35 U.S.C. 154(b) by 0 days.

(21) Appl. No.: 16/840,067

(22) Filed: Apr. 3, 2020

(51) Int. Cl.

| | |
|---|---|
| ***A47B 9/00*** | (2006.01) |
| ***A47B 91/00*** | (2006.01) |
| ***A47B 3/00*** | (2006.01) |
| ***A47G 23/02*** | (2006.01) |

(52) U.S. Cl.
CPC ..... *A47B 9/00* (2013.01); *A47B 3/002* (2013.01); *A47B 91/00* (2013.01); *A47G 23/0225* (2013.01); *A47B 2003/004* (2013.01)

(58) Field of Classification Search
CPC .... A47B 9/00; A47B 9/18; A47B 9/20; A47B 2009/006; A47B 3/002; A47G 23/0225
See application file for complete search history.

(56) References Cited

U.S. PATENT DOCUMENTS

| | | | | |
|---|---|---|---|---|
| 732,585 | A * | 6/1903 | Reinhardt | A47B 9/18 108/19 |
| 2,398,693 | A * | 4/1946 | Bureau | A47B 9/08 108/11 |
| 5,865,127 | A * | 2/1999 | Carter | A47B 3/12 108/115 |
| 7,267,309 | B2 * | 9/2007 | Hanson | A47B 91/024 248/188.1 |
| 7,469,642 | B1 * | 12/2008 | LeDoux | A47B 9/00 108/12 |
| 8,424,470 | B2 * | 4/2013 | Volin | A47B 3/091 108/118 |
| 8,915,195 | B2 | 12/2014 | Berkowitz | |
| D725,949 | S | 4/2015 | Berkowitz | |

(Continued)

FOREIGN PATENT DOCUMENTS

| | | | | |
|---|---|---|---|---|
| DE | 202018002470 U1 * | 6/2018 | | A47B 9/18 |
| FR | 2094783 A5 * | 2/1972 | | A47B 9/18 |
| FR | 2590461 A1 * | 5/1987 | | B60B 33/0002 |

OTHER PUBLICATIONS

Translation of FR 2094783 (Year: 2020).*
Translation of FR 2590461 (Year: 2020).*
Translation of DE 202018002470 (Year: 2000).*

*Primary Examiner* — Daniel J Rohrhoff
(74) *Attorney, Agent, or Firm* — Morland C. Fischer

(57) ABSTRACT

An adjustable-height folding table adapted to be expanded to an unfolded configuration when being used and collapsed to a compact folded configuration when not being used for purposes of transport or storage. The folding table has a first plurality of legs extending between the table top and a corresponding plurality of footpads and a second plurality of legs that are pivotally coupled to respective ones of the footpads. The second plurality of legs are rotatable relative to the footpads between a first position extending downwardly from the footpads and away from the top of the table and a second position extending upwardly from the footpads and towards the table top. The second plurality of legs are rotated to lay on the ground in their first position, and the footpads lay on the ground when the second plurality of legs are rotated to their second position.

19 Claims, 7 Drawing Sheets

(56) References Cited

U.S. PATENT DOCUMENTS

| | | | | |
|---|---|---|---|---|
| 9,364,093 | B2 * | 6/2016 | Williams | A47B 91/005 |
| 9,788,673 | B2 * | 10/2017 | Gschwind, Jr. | A47G 23/0225 |
| 2009/0241811 | A1 * | 10/2009 | Markegard | A47B 3/00 108/118 |
| 2014/0090582 | A1 * | 4/2014 | Grace | A47B 9/14 108/106 |
| 2014/0261093 | A1 * | 9/2014 | Berkowitz | A47B 13/16 108/25 |
| 2019/0226633 | A1 * | 7/2019 | Hoyle | F16M 11/245 |
| 2020/0003243 | A1 * | 1/2020 | Perelman | A47B 3/002 |

* cited by examiner

ADJUSTABLE-HEIGHT FOLDING TABLE

BACKGROUND OF THE INVENTION

1. Field of the Invention

This invention relates to an adjustable-height folding table that is adapted to be expanded to an unfolded configuration when it is to be used and collapsed to a compact folded configuration when it will not be used at which to be suitable for transport or storage. The folding table includes a set of height-adjusting legs that are rotatable from a vertically upstanding position pointing upwardly towards the top of the table such that the table has a relatively short height above the ground on which it stands to a vertically downward position pointing away from the table top such that the table now has a relatively tall height above the ground.

2. Background Art

Tables are known which have a variety of applications for use inside and out of doors. In one case, where a table will be used out of doors, the users may be seated on the ground. By way of example, the table may be standing in sand at the beach. In another case, the users may be seated on chairs or benches around the table. In this case, the table may be standing on hard ground at a campsite or picnic grounds. In the first case, users of the table are seated relatively low to the sand and, in the other case, the users are seated relatively high off the ground. Because of the height differences at which the users will be seated, it is difficult to be able to use the same table at both the beach and at the picnic grounds. Consequently, users may have to have access to more than one table for use at the aforementioned two outdoor locations.

Tables are also known that are folded into a compact shape when they are not in use. Typically, the legs of the table fold under the table top. However, in many cases, such folded tables are still too large to be easily stored in a closet or transported in the trunk of an automobile. Moreover, conventional folded tables are not ideally sized to be carried in a bag or a sack that is strapped to the back of a user.

SUMMARY OF THE INVENTION

In general terms, an adjustable-height folding table is disclosed that is adapted to be expanded to an unfolded configuration when it is used and collapsed to a compact folded configuration during periods of non-use so as to be suitable for transport or storage. In its compact folded configuration, the table has a size that is ideal to be carried in a sack or bag that can be strapped to the back of a user.

The folding table has a (e.g., rectangular) flexible fabric table top with a plurality of cup holders hanging downwardly therefrom. Extending between each corner of the table and a flat footpad that is spaced downwardly from the table top are a pair of telescoping tubular inner and outer leg members. One end of a rotatable height adjusting leg is pivotally connected within a tapered channel that is affixed to and stands upwardly from each footpad. Therefore, a plurality of (e.g., four) height adjusting legs are located below the corners of the table and rotatable relative to the flat footpads to which respective ones of the channels are affixed. When it is desirable for the folding table to have a relatively tall height while standing on the ground such as at a picnic site or camp grounds, each of the height adjusting legs is rotated at its channel so as to lie below the flat footpad to which the channel is affixed and point downwardly away from the table top. In this case, the height adjusting legs lay on the ground on which the table is supported. When it is desirable for the folding table to have a relatively short height while standing in sand at the beach, each of the height adjusting legs is rotated at its channel so as to lie entirely above the flat footpad and point upwardly towards the table top. In this case, the footpads above which the height adjusting legs are rotated, lay on the sand on which the table is supported.

When the folding table has a tall height in its expanded unfolded configuration, a retractable leg locking pin extends from the inner leg member and outwardly through a hole in the outer leg member of one of the pairs of telescoping inner and outer leg members. In its outwardly extending position, the leg locking pin prevents the outer leg member from sliding over and along the telescoping inner leg member. The pairs of telescoping inner and outer leg members that lie below the corners of the folding table are coupled to one another by pairs of leg braces that are pivotally connected to each other and run diagonally across each side of the table. When it is desirable to collapse the folding table from its expanded unfolded configuration to its compact folded configuration, the leg locking pin is depressed inwardly of the outer leg member of the one pair of telescoping inner and outer leg members. Accordingly, the outer leg members of all of the telescoping pairs of leg members are now permitted to simultaneously slide upwardly and over their inner leg members. At the same time, applying a compressive pushing force to opposite sides of the folding table causes each of the pairs of pivotally connected leg braces at the sides of the table to rotate together, whereby to collapse the table inwardly of itself into its compact folded configuration.

DESCRIPTION OF THE PREFERRED EMBODIMENT

Figure 1:
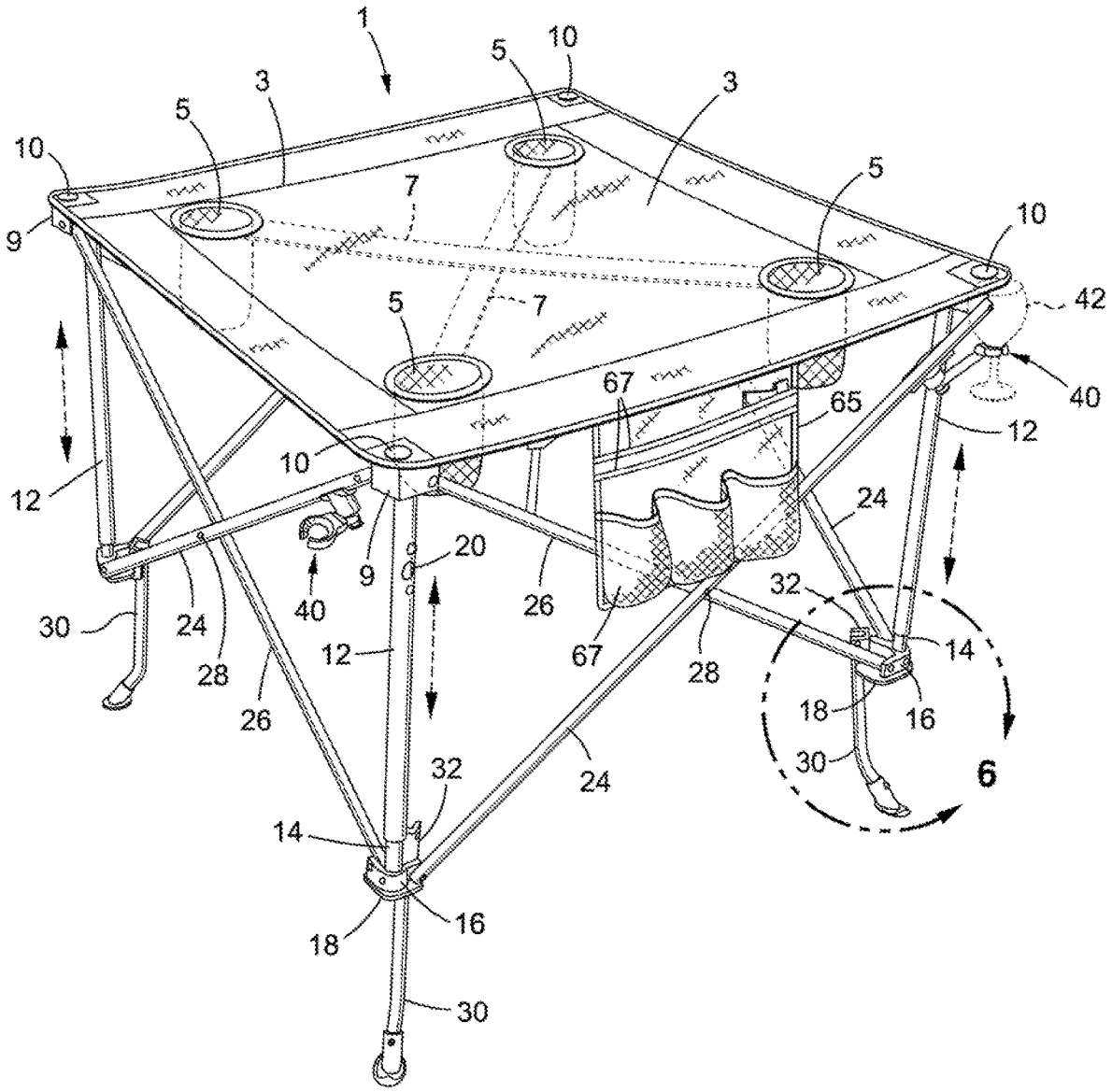
FIG. 1 is a perspective view showing a preferred embodiment for an adjustable-height folding table expanded to an unfolded configuration and having a plurality of rotatable height adjusting legs rotated downwardly so that the table has a relatively tall height.

A preferred embodiment for an adjustable-height folding table 1 is now disclosed while referring to the drawings. As will soon be described, the folding table 1 is adapted to be collapsed and expanded between an unfolded configuration when it is in use and a compact folded configuration when it is not in use. Moreover, the folding table 1 includes a set of adjustable corner supports that can be manipulated to change the elevation of the table depending upon the application of the table and the location at which the table is used. By way of example, the adjustable corner supports can be manipulated to have a tall height when the table 1 is used out of doors to stand on the ground at a camping or a picnic site. The adjustable corner supports can also be manipulated to have a short height when the table 1 stands on sand at the beach.

Figure 2:
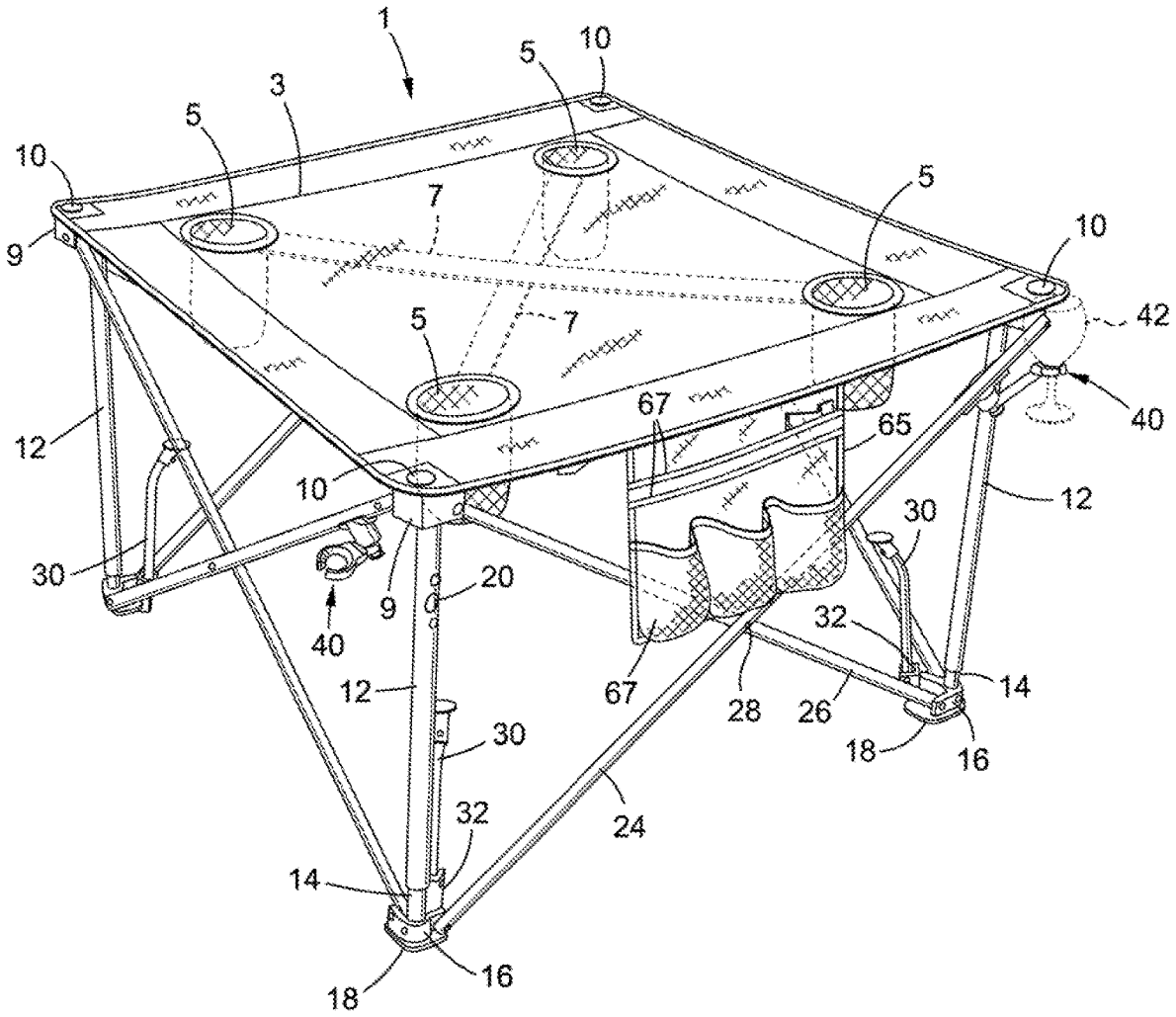
FIG. 2 is a perspective view of the adjustable-height folding table shown in FIG. 1 with the rotatable height adjusting legs thereof rotated upwardly so that the table has a relatively short height.
Figure 3:
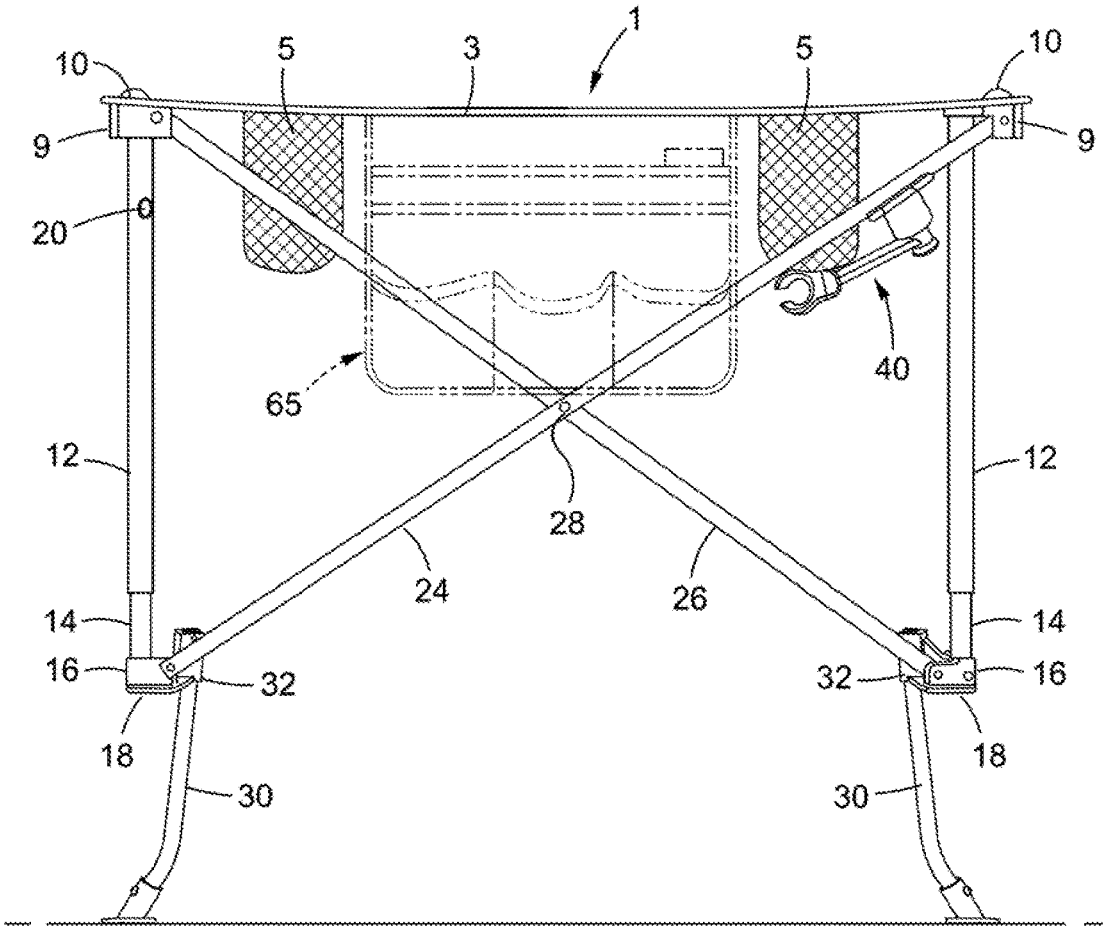
FIG. 3 is a side view of the adjustable-height folding table of FIG. 1 with the height adjusting legs thereof rotated downwardly.
Figure 4:
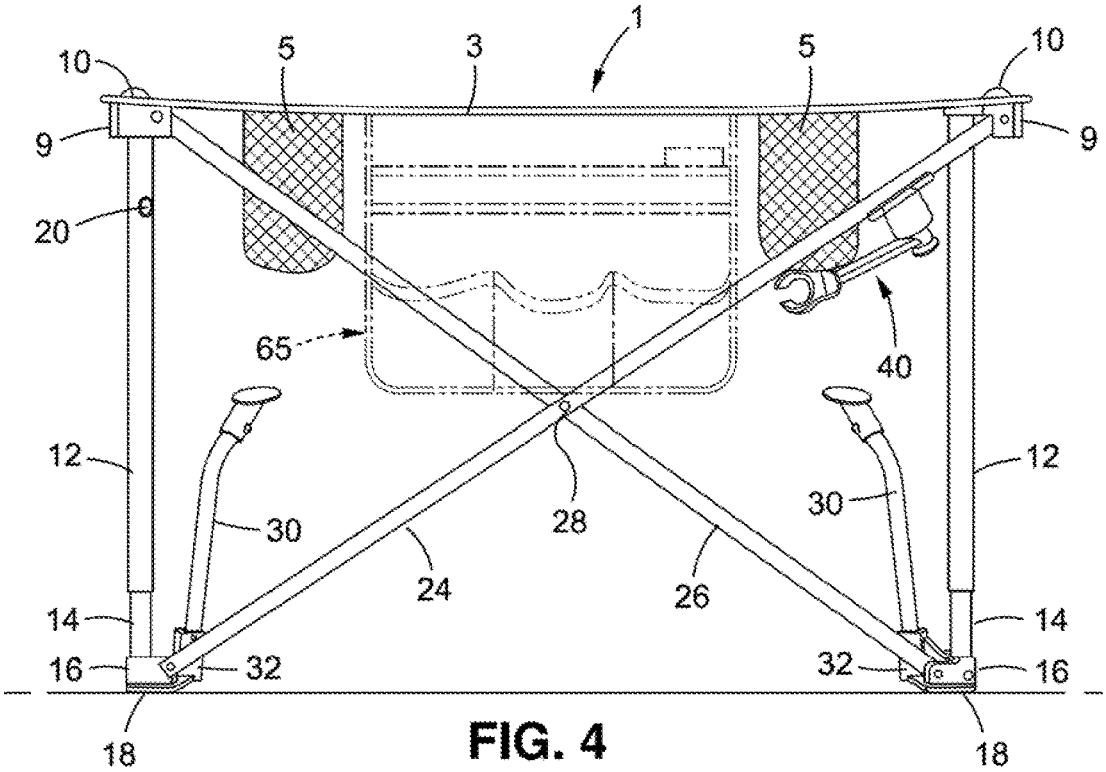
FIG. 4 is a side view of the adjustable-height folding table of FIG. 2 with the height adjusting legs thereof rotated upwardly.

Referring initially in this regard to FIGS. 1-5 of the drawings, there is shown the aforementioned adjustable-height folding table 1. FIGS. 1 and 3 show the folding table 1 in an expanded configuration with its corner supports having a relatively tall height above the a surface, and FIGS. 2 and 4 show the folding table 1 in the same expanded configuration with its corner supports now having a relatively short height above the same or a different surface. The table 1 has a flexible fabric top 3 extending thereover. For purposes of illustration, the flexible top 3 of the table 1 is shown as being square or rectangular. However, the table top 3 may have other (e.g., round) shapes to suit the needs of a user.

Figure 5:
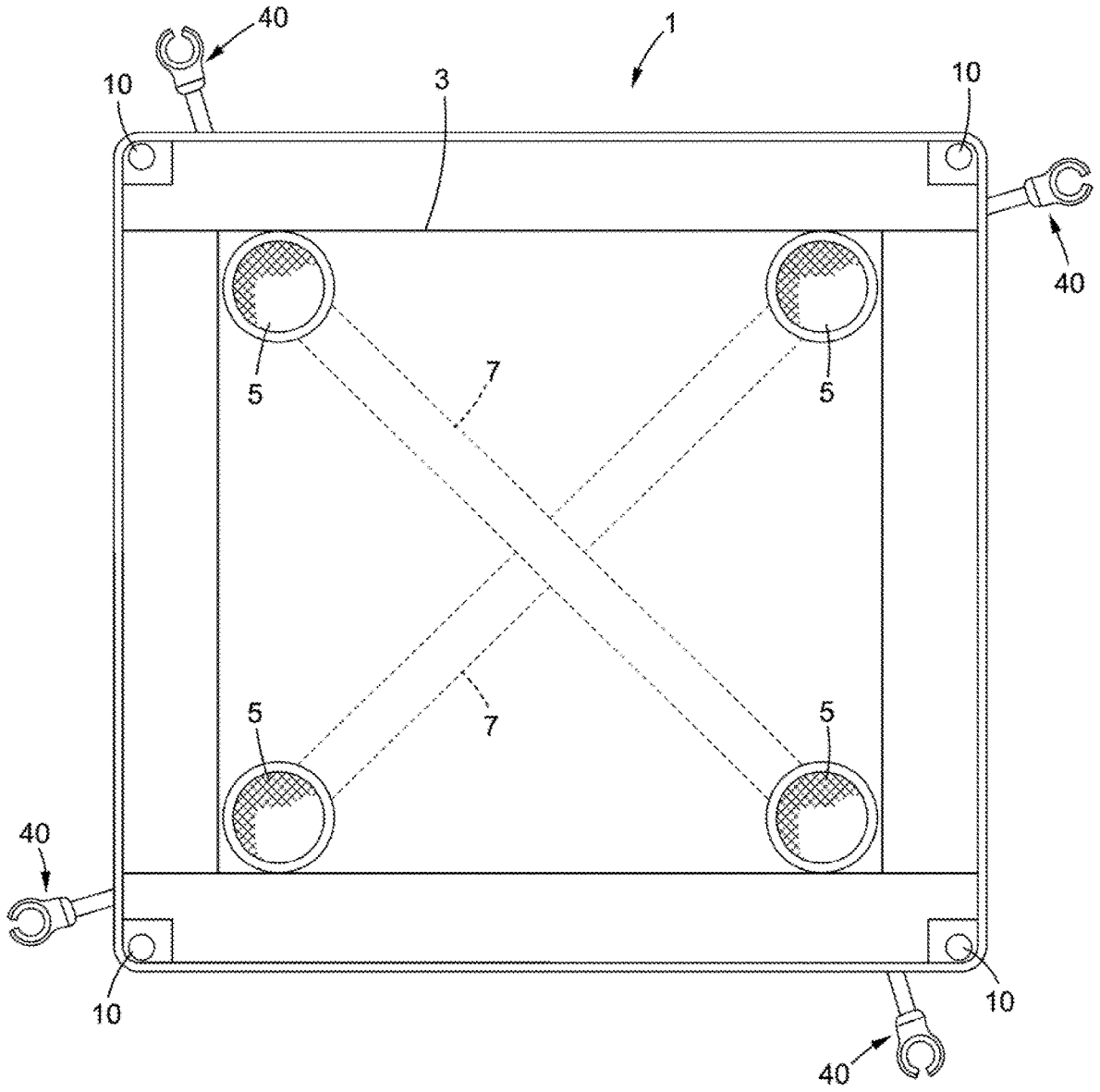
FIG. 5 is a top view of the adjustable-height folding table.

A set of four cylindrical (e.g., mesh) cup holders 5 hang downwardly from locations adjacent the corners of the flexible table top 3. The cup holders 5 are configured to receive therewithin either cups, bottles or beverage containers (not shown). A pair of (e.g., nylon) straps 7 extend diagonally across the table top 3 between pairs of the cup holders 5. As best shown in FIG. 5, the straps 7 are attached (e.g., sewn) underneath the table top 3 to reinforce the top 3 and prevent it from sagging, especially when supporting a heavy load during use.

The corners of the flexible table top 3 are connected to respective coupling blocks 9 by means of button head fasteners 10. First ends of a set of (e.g., four) tubular outer leg members 12 are fixedly connected to respective ones of the coupling blocks 9. The tubular outer leg members 12 are hollow so as to telescopically receive within the opposite ends thereof the first ends of a corresponding set of tubular inner leg members 14. The set of outer leg members 12 are adapted to slide upwardly and downwardly over the set of inner leg members 14 when the table is collapsed and expanded. The opposite ends of the tubular inner leg members 14 are fixedly connected to respective coupling brackets 16 that are spaced below the coupling blocks 9 at the corners of the folding table 1. Each coupling bracket 16 is affixed to a flat footpad 18. When the corner supports of the folding table 1 have their aforementioned short height of FIGS. 2 and 4, the flat footpads 18 of the table 1 will stand on the floor, ground, sand, or similar surface. However, and as will be explained in greater detail hereinafter, when the corner supports of the table 1 have their tall height of FIGS. 1 and 3, the flat footpads 18 are held off the floor, ground or sand.

A retractable leg locking pin 20 is normally biased so as to extend from within a single one of the tubular inner leg members 14 and project through a hole outwardly from the particular tubular outer leg member 12 that surrounds the one inner leg member 14. With the folding table 1 in an unfolded configuration as shown in FIGS. 1-4, the outwardly projecting leg locking pin 20 prevents the outer leg member 12 from sliding over its inner leg member 14. Being that one pair of telescoping outer and inner leg members 12 and 14 are held (i.e., locked) stationary relative to one another by the outwardly projecting leg locking pin 20, all of the other pairs of outer and inner leg members of the folding table 1 are likewise held stationary. A pushing force applied to the retractable leg locking pin 20 causes the locking pin to move inwardly through the outer leg member 12, whereby to permit all of the outer leg members 12 to simultaneously slide upwardly over and along their inner leg members 14 so that the table 1 can be collapsed from its unfolded configuration of FIGS. 1-4 to its unfolded configuration of FIG. 10.

Running diagonally across each side of the folding table 1 below the top 3 is a pair of tubular leg braces 24 and 26. The leg braces 24 and 26 cross one another at about their midpoints at which a pivot (e.g., a rivet) 28 is inserted therethrough. More particularly, each one of the pair of leg braces 24 and 26 at each side of the table 1 is pivotally connected at a lower end thereof to a respective coupling bracket 16 to which the inner leg member 14 of a pair of telescoping leg members 12 and 14 is also connected. The opposite upper end of each one of the pair of leg braces 24 and 26 is pivotally connected to a respective coupling block 9 that lies below the table top 3 to which the outer leg member 12 of an adjacent pair of telescoping leg members 12 and 14 is also connected. As will be explained when referring to FIG. 10, the pairs of leg braces 24 and 26 at the sides of the folding table 1 will rotate at their respective pivots 28 whenever the folding table 1 is collapsed and expanded between its aforementioned unfolded and folded configurations.

It may be appreciated that each one of the pairs of leg braces 24 and 26 at the sides of the folding table 1 is coupled to an adjacent pair of leg braces by means of the coupling blocks 9 and coupling brackets 16. By virtue of the foregoing, and as was previously described, all of the tubular outer leg members 12 will simultaneously slide upwardly over and along their telescopically received tubular inner leg members 14 when the leg locking pin 20 that projects from one of the outer leg members 12 is depressed in order to permit the folding table 1 to be collapsed from its expanded unfolded configuration of FIGS. 1-4 to its collapsed folded configuration of FIG. 10.

As an important feature of the adjustable-height folding table 1, the aforementioned adjustable corner supports of the table include a plurality of (e.g., four) rotatable height adjusting legs 30 that are manipulated so that the table 1 will have either a short height or a tall height depending upon its location and use. Each height adjusting leg 30 is preferably located below one of the corners of the table 1. A corresponding plurality of (e.g., four) tapered channels 32 are fixedly connected to respective ones of the flat footpads 18 to which the tubular inner leg members 14 are connected. As is best shown in FIGS. 2 and 4, the tapered channels 32 stand upwardly from the footpads 18.

One end of each rotatable height adjusting leg 30 is removably received within a respective upstanding channel 32. The height adjusting leg 30 makes a tight fit within its tapered channel 32 so as to be held in place by friction. A pivot (e.g., rivet) 34 extends through the channel 32 and the height adjusting leg 30 received therewithin such that the leg 30 is rotatable back and forth around pivot 34 into and out of its engagement with the channel 32. That is, a pulling force applied to the height adjusting leg 30 that is sufficient to break the frictional retention of the tight fitting leg 30 within the tapered channel 32 causes the leg 30 to rotate at pivot 34 out of its channel.

Figure 6:
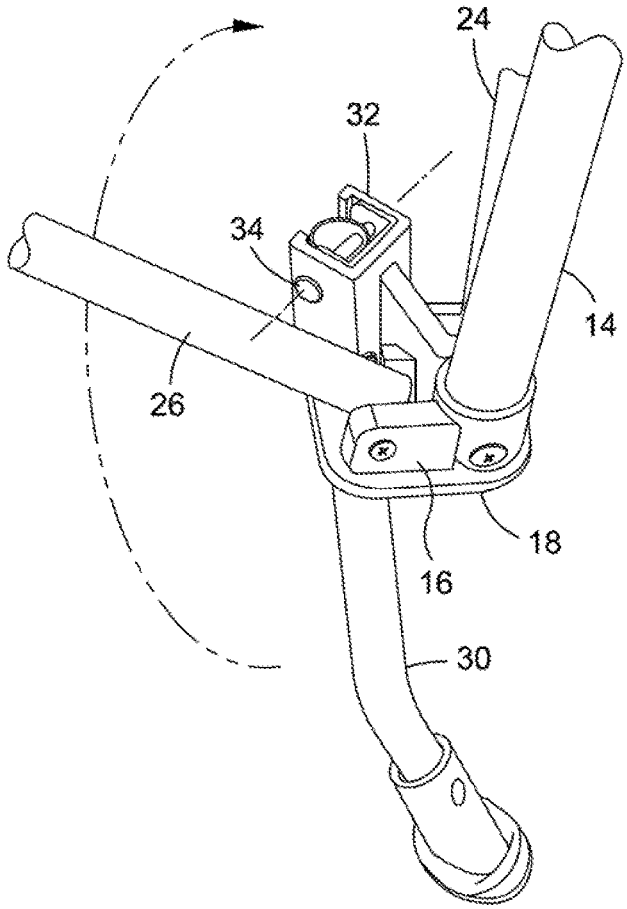
FIG. 6 is an enlarged detail taken from FIG. 1 showing one of the rotatable height adjusting legs of the adjustable-height folding table rotated downwardly by which to increase the height of the table.

Referring in this regard to FIG. 6 of the drawings, one of the rotatable height adjusting legs 30 is shown after it has been pulled out of engagement with its channel 32 so that the leg rotates around pivot 34 through an angle of approximately 180 degrees to extend vertically downward from the channel and pointing away from the table top 3. In this case, the height adjusting leg 30 extends below the footpad 18 to which the channel 32 is connected and below the inner leg member 14 (best shown in FIGS. 1 and 3). When the folding table 1 is located on a surface with all of its height adjusting legs 30 rotated vertically downward as just described, the table will stand upon each of the legs 30. The distance between the table top 3 and the surface is the sum of the lengths of a pair of telescoping outer and inner leg members 12 and 14 and the height adjustment leg 30, whereby the folding table 1 has a relatively tall height, and the table top 3 is held high off the ground.

Figure 7:
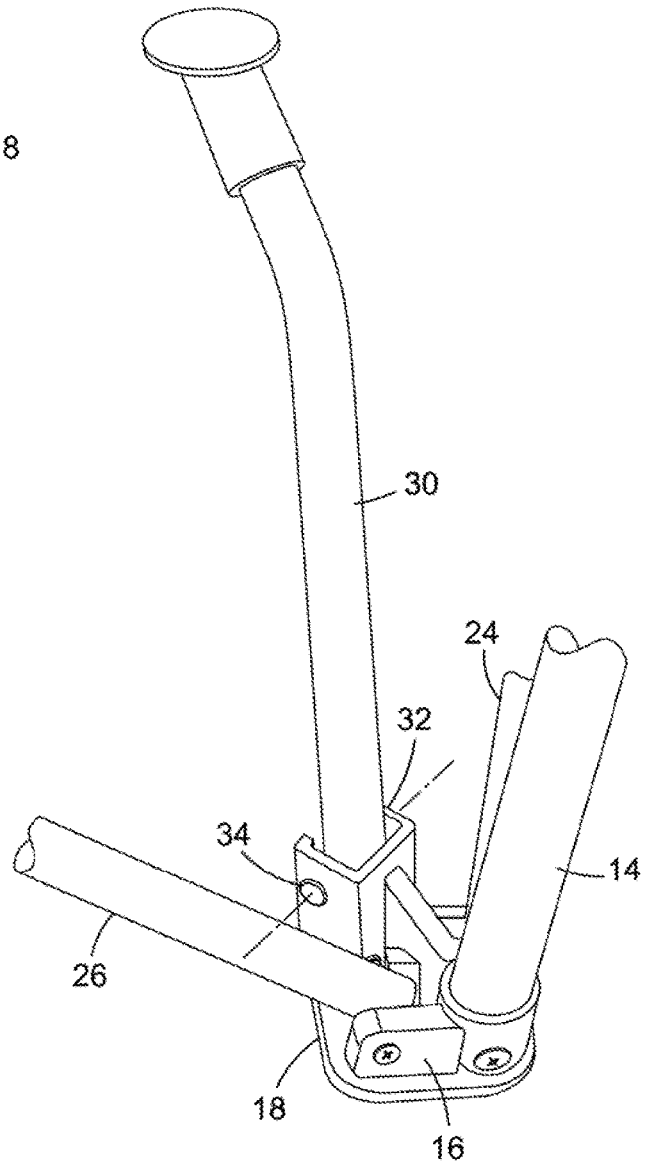
FIG. 7 shows the one rotatable height adjusting leg of FIG. 6 after it has been rotated upwardly by which to reduce the height of the table.

FIG. 7 of the drawings shows the rotatable height adjusting leg 30 of FIG. 6 being frictionally retained within its channel 32 so that the leg 30 stands vertically upward from the channel. In this case, the height adjusting leg 30 is rotated in an opposite direction around pivot 34 so as to lie entirely above the footpad 18 to which the channel 32 is connected. The height adjusting leg 30 is pointed towards the table top 3 so as to lie alongside one of the outer leg members 12 (best shown in FIGS. 2 and 4). When the folding table 1 is located on a surface with its height adjusting legs 30 standing upwardly as just described, it will stand entirely upon the flat footpads 18. The distance between the table top 3 and the surface is now substantially the length of a pair of the telescoping outer and inner leg members 12 and 14, whereby the folding table 1 has a relatively short height, and the table top 3 is held low to the surface. It is to be understood, however, that the short height of the table 1 may also be achieved by rotating the height adjusting legs 30 to lie in parallel alignment with the table top.

Figure 8:
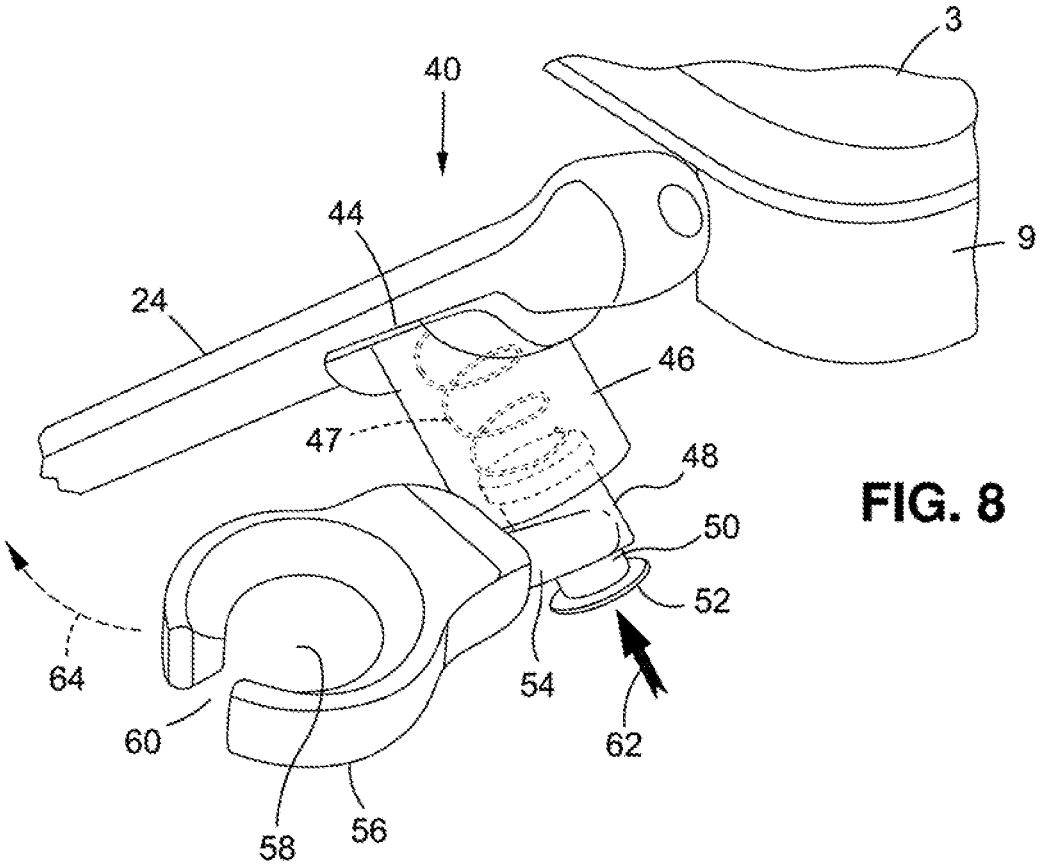
FIGS. 8 and 9 show a rotatable wine glass holder connected to one side of the adjustable-height folding table at which to carry a conventional wine glass.
Figure 9:
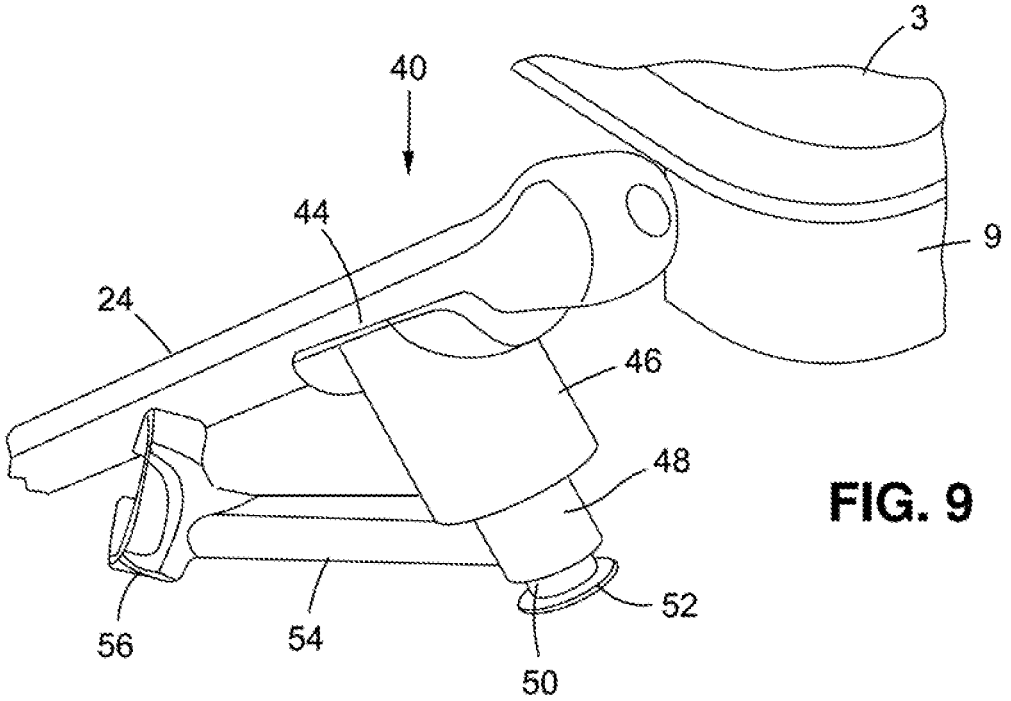

Another important feature of the adjustable-height folding table 1 of this invention is described while referring to FIGS. 8 and 9 of the drawings where there is shown a rotatable wine glass holder 40 that is adapted to carry a conventional wine glass (designated 42 and shown in broken lines in FIGS. 1 and 2) of the kind having a narrow stem connected to a wide bowl. Because the rectangular folding table 1 described herein has four sides, four identical wine glass holders 40 are shown in FIG. 5 being attached to the sides of the table. However, the number of wine glass holders 40 attached to the folding table 1 should not be considered as a limitation of this invention.

Each wine glass holder 40 is attached to one of the tubular leg braces 24 that runs diagonally across one side of the folding table 1 by means of a mounting collar 44 that is fixedly connected to leg brace 24. A cylindrical lock and release barrel 46 that encloses a (e.g., coil) spring 47 (represented by the broken lines shown in FIG. 8) extends from the mounting collar 44. One end of a swivel arm cylinder 48 is received inwardly of and rotatable relative to the lock and release barrel 46. A cylindrical neck 50 that is joined to a push-button 52 is slidably received within the opposite end of the swivel arm cylinder 48. The neck 50 of push-button 52 communicates with the spring 47 that is enclosed by the lock and release barrel 46.

One end of a swivel arm 54 is connected to the rotatable swivel arm cylinder 48 so as to rotate therewith. A wine glass seat 56 of the wine glass holder 40 is attached to the opposite end of the swivel arm 54. The wine glass seat 56 has a center hole 58 extending therethrough. An entrance/exit slot 60 runs through the wine glass seat 56 to communicate with the center hole 58. The wine glass seat 56 and the center hole 58 thereof are configured to support the round bowl of a traditional wine glass (designated 42 in FIGS. 1 and 2) so that when the elongated stem of the wine glass is moved inwardly through the entrance/exit slot 60 of the wine glass seat 56, the bowl of the wine glass will rest upon and be supported by the seat 56. The wine glass is lifted off the wine glass seat 56 and removed from the wine glass holder 40 by withdrawing the wine glass stem outwardly through the entrance/exit slot 60.

The spring 47 that is housed within the lock and release barrel 46 is normally expanded so as to apply an outward pushing force to the neck 50 of the push-button 52 and thereby urge the neck 50 and the push-button 52 to move outwardly and away from the swivel arm cylinder 48. In this case, the rotatable swivel arm cylinder 48, the swivel arm 54 extending from cylinder 48, and the wine glass seat 56 attached to the swivel arm 54 are all locked in place so that the wine glass holder 40 and the wine glass 42 shown in FIGS. 1 and 2 remain stationary at one side of the folding table 1 so as to be readily accessible to one seated at the table.

Figure 10:
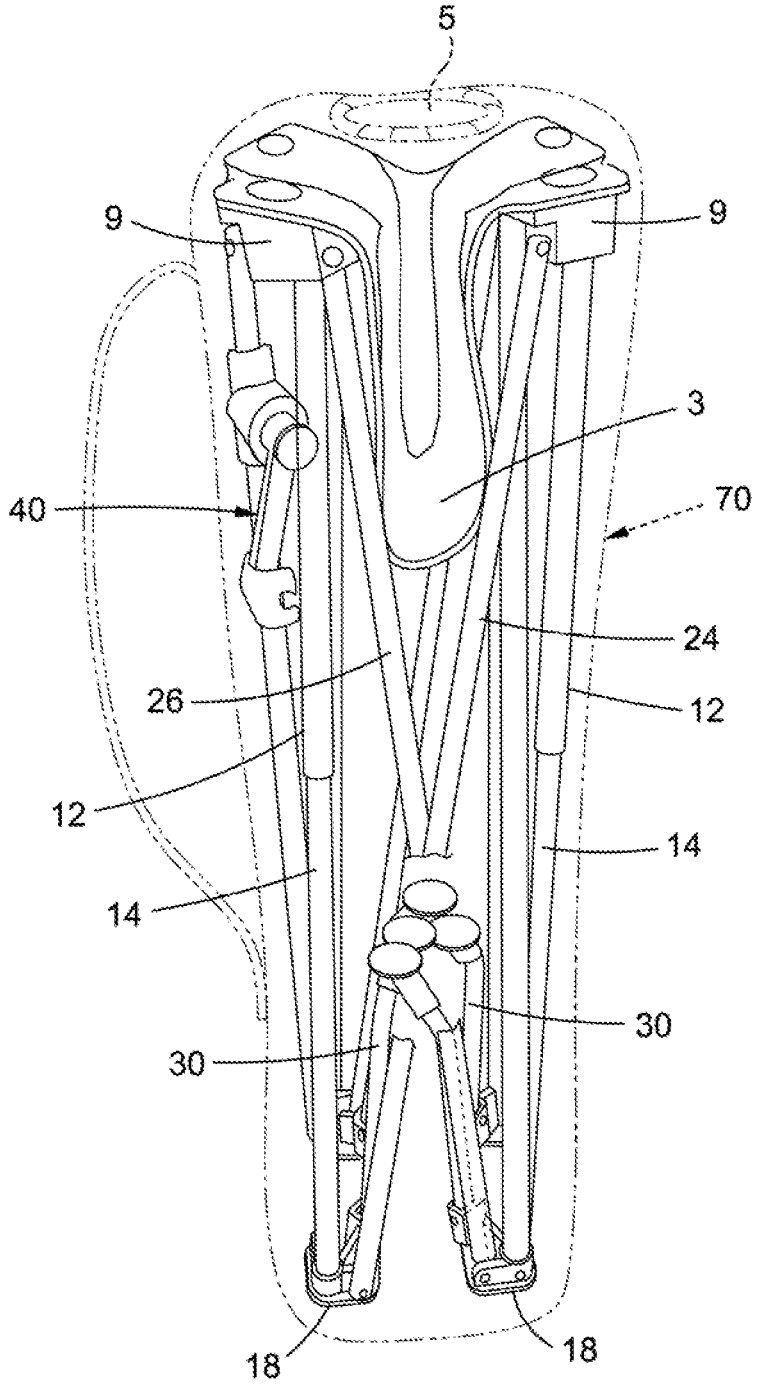
FIG. 10 shows the adjustable-height folding table after it has been collapsed into a compact folded configuration suitable to be carried in a bag and strapped to the back of a user.

However, when the wine glass holder 40 is not being used or the folding table 1 will be collapsed to its folded configuration of FIG. 10, a pushing force is applied to the push-button 52 in the direction of the arrow 62 shown in FIG. 8. The neck 50 of push-button 52 is thusly pushed inwardly of the rotatable swivel arm cylinder 48, and the spring 47 that is housed within the lock and release barrel 46 is temporarily compressed. In this case, the swivel arm cylinder 48 and the swivel arm 54 attached thereto are now unlocked, whereby the wine glass seat 56, the swivel arm 54, and the swivel arm cylinder 48 are all rotatable with one another in the direction of arrow 64 relative to the lock and release barrel 46. Accordingly, as is best shown in FIG. 4, the wine glass holder 40 can be repositioned to an out of the way location below the table top 3 so as to lie alongside the leg brace 24 to which it is connected.

Turning now to FIG. 10 of the drawings, the variable height folding table is shown after it is collapsed from its unfolded configuration of FIGS. 1-5 ready for use to its compact folded configuration ideal for storage or transport. As explained earlier, the table 1 is folded by fast depressing the single leg locking pin 20 inwardly of its tubular outer leg member 12 through which the pin projects. With the leg locking pin 20 depressed, all of the formerly locked in place tubular outer leg members 12 are now able to simultaneously slide over and along their telescoping inner leg members 14. In this regard, a compressive squeezing force applied to opposite sides of the folding table 1 causes the pairs of telescoping outer and inner leg members 12 and 14 to move towards one another and the flexible table top 3 to fold up. At the same time, the outer leg members 12 slide upwardly and over their inner leg members 14. Likewise, each of the pairs of diagonally extending leg braces 24 and 26 at the sides of the table rotate at their respective pivots 28 towards one another. In addition, the upper ends of each pair of leg braces 24 and 26 at each side of the table 1 rotate at their pivot connections with respective coupling blocks 9, and the lower ends of each pair of leg braces 24 and 26 rotate at their pivot connections with respective coupling brackets 16 until the folding table 1 has been collapsed inwardly upon itself as shown in FIG. 10 to be sized for being carried within the trunk of a motor vehicle or in a bag 70 that can be strapped to the back of a user.

An additional feature of the variable-height folding table 1 is shown in FIGS. 1-4. A flexible utility flap 65 is attached (e.g., sewn) to the table top 3 and hangs downwardly therefrom to lie along one side of the table 1. Any convenient number of utility flaps in addition to that shown may be attached to the table. The utility flap 65 is provided with a set of pockets 67 of various sizes and shapes by which to hold therewithin a variety of articles (e.g., napkins and eating utensils, a bottle opener and snacks, to name but a few).

The invention claimed is:

1. A table adapted to stand on a surface and comprising:

a top manufactured from a flexible material;

a plurality of supports, each of said plurality of supports including a tubular outer leg member extending downwardly from the flexible top of said table and a tubular inner leg member extending upwardly from a respective one of a plurality of footpads to be telescopically received within said tubular outer leg member;

said plurality of supports being movable towards one another to cause said flexible top to fold up and said table to collapse inwardly upon itself in response to a compressive pushing force applied to said table, the tubular outer leg member of each of said plurality of supports sliding upwardly and over said tubular inner leg member when said plurality of supports move towards one another and said flexible top folds up;

a retractable leg locking pin extending from the tubular inner leg member of one of said plurality of supports and outwardly through the tubular outer leg member thereof to prevent said tubular outer leg member from sliding upwardly and over said tubular inner leg member, said leg locking pin being responsive to a pushing force by which to move inwardly of said tubular outer leg member and thereby permit said tubular outer leg member to slide upwardly and over said tubular inner leg member when said plurality of supports move towards one another, said flexible to folds up, and said table is collapsed inwardly upon itself; and a plurality of height-adjusting legs being rotatable relative to said plurality of footpads between a first position extending below said plurality of footpads so that said plurality of height-adjusting legs lay upon the surface and a second position extending above said plurality of footpads so that said plurality of footpads lay upon said surface, said table having a first height measured between the surface and the top of said table when said plurality of height-adjusting legs are rotated to said first position, and said table having a second, shorter height measured between the surface and the top of said table when said plurality of height-adjusting legs are rotated to said second position.

2. The table recited in claim 1, wherein said plurality of height-adjusting legs point downwardly and away from the top of said table when said legs are rotated to said first position, and said plurality of height-adjusting legs point towards the top of said table when said legs are rotated to said second position.

3. The table recited in claim 1, wherein said plurality of height-adjusting legs are pivotally connected to respective ones of said plurality of footpads so as to be rotatable relative to said footpads between said first and second positions.

4. The table recited in claim 1, further comprising a plurality of channels fixedly connected to respective ones of said plurality of footpads, said plurality of height-adjusting legs being received within and pivotally connected to respective ones of said plurality of channels, such that said height-adjusting legs are rotatable into and out of said channels between said first and second positions.

5. The table recited in claim 1, further comprising a plurality of cup holders connected to and depending downwardly from the top of said table.

6. The table recited in claim 1, wherein the flexible top of said table has at least one strap of fabric reinforcing material extending thereacross to prevent said top from sagging under a load.

7. The table recited in claim 1, wherein said plurality of supports are coupled to one another by means of corresponding pairs of first and second leg braces that are pivotally connected to one another, each of said pairs of first and second leg braces also being pivotally connected to and extending diagonally between adjacent ones of said plurality of supports such that said first and second leg braces of each pair thereof rotate towards one another when said plurality of supports move towards one another and said flexible top folds up.

8. The table recited in claim 1, further comprising a wine glass holder adapted to hold a wine glass having a wide bowl in which to hold wine and a narrow stem depending from the bowl, said wine glass holder connected to said table and having a wine glass seat on which to support the bowl of the wine glass, said wine glass seat having a slot formed therein through which to receive the stem of the wine glass.

9. The table recited in claim 8, wherein said wine glass holder includes a swivel arm having a first end pivotally coupled to said table and an opposite end connected to said wine glass seat, said swivel arm being rotatable relative to said table to correspondingly rotate said wine glass seat and the wine glass being held by said wine glass holder.

10. The table recited in claim 9, wherein said wine glass holder also includes a push-button that is positioned to communicate with the second end of said swivel arm to lock said swivel arm in place and prevent the rotation of said swivel arm relative to said table, said push-button being responsive to a pushing force applied thereto to unlock said swivel arm and permit a rotation of said swivel arm and the wine glass held by said wine glass holder.

11. A table adapted to stand on a surface and comprising, a table top;

a first plurality of legs extending downwardly from said table top;

a second plurality of legs coupled to said first plurality of legs at respective ones of a plurality of footpads, said second plurality of legs being rotatable relative to said first plurality of legs between a first position extending downwardly from said plurality of footpads and below said first plurality of legs and a second position lying alongside said first plurality of legs; and a plurality of channels fixedly connected to respective ones of said plurality of footpads, said second plurality of leas being received within and pivotally connected to respective ones of said plurality of channels, such that said second plurality of legs are rotatable into and out of said channels between said first and second positions.

12. The table recited in claim 11, wherein said second plurality of legs point downwardly and away from said table top when said second plurality of legs are rotated to said first position, and said second plurality of legs point upwardly and towards said table top when said second plurality of legs are rotated to said second position.

13. The table recited in claim 11, wherein said plurality of footpads are configured to lay on the surface on which said table stands when said second plurality of legs are rotated to said second position, and said second plurality of legs are configured to lay on the surface when said second plurality of legs are rotated to said first position.

14. The table recited in claim 11, wherein the height of said table between the table top and the surface on which said table stands is greater when said second plurality of legs are rotated to said first position than when said plurality of legs are rotated to said second position.

15. The table recited in claim 11, wherein the top of said table is manufactured from a flexible material, said table being collapsible inwardly upon itself in response a compressive pushing force applied thereto, such that said first plurality of legs move toward one another and said flexible top folds up.

16. The table recited in claim 15, wherein each of said first plurality of legs includes a tubular outer leg member extending downwardly from the flexible top of said table and a tubular inner leg member extending upwardly from a respective one of said plurality of footpads to be telescopically received within said tubular outer leg member, the tubular outer leg member of each of said first plurality of legs sliding upwardly and over said tubular inner leg member when said first plurality of legs move towards one another and said flexible top folds up.

17. The table recited in claim 16, further comprising a retractable leg locking pin extending from the tubular inner leg member of one of said first plurality of legs and outwardly through the tubular outer leg member thereof to prevent said tubular outer leg member from sliding upwardly and over said tubular inner leg member, said leg locking pin being responsive to a pushing force by which to move inwardly of said tubular outer leg member and thereby permit said tubular outer leg member to slide upwardly and over said tubular inner leg member when said first plurality of legs move towards one another, said flexible top folds up, and said table is collapsed inwardly upon itself.

18. A table adapted to stand on a surface and comprising:

a top manufactured from a flexible material;

a plurality of legs, each of said plurality of legs including a tubular outer leg member extending downwardly from the flexible top of said table and a tubular inner leg member extending upwardly towards said tubular outer leg member to be telescopically received within said tubular outer leg member;

said plurality of legs being movable towards one another to cause said flexible top to fold up and said table to collapse inwardly upon itself in response to a compressive pushing force applied to said table such that the tubular outer leg member of each of said plurality of legs slides upwardly and over said tubular inner leg member when said plurality of legs move towards one another and said flexible top folds up; and a retractable leg locking pin extending from the tubular inner leg member of one of said plurality of legs and outwardly through the tubular outer leg member thereof to prevent said tubular outer leg member from sliding upwardly and over said tubular inner leg member, said leg locking pin being responsive to a pushing force by which to move inwardly of said tubular outer leg member and thereby permit said tubular outer leg member to slide upwardly and over said tubular inner leg member when said plurality of legs move towards one another, said flexible top folds up, and said table is collapsed inwardly upon itself.

19. A table adapted to stand on a surface and comprising:

a top;

a plurality of supports having first ends coupled to said top and opposite ends coupled to respective ones of a plurality of footpads;

a plurality of height-adjusting legs being rotatable relative to said plurality of footpads between a first position extending below said plurality of footpads so that said plurality of height-adjusting legs lay upon the surface and a second position extending above said plurality of footpads so that said plurality of footpads lay upon said surface, said table having a first height measured between the surface and the top of said table when said plurality of height-adjusting legs are rotated to said first position, and said table having a second, shorter height measured between the surface and the top of said table when said plurality of height-adjusting legs are rotated to said second position; and a wine glass holder adapted to hold a wine glass having a bowl in which to hold wine and a stem depending from the bowl, said wine glass holder connected to said table and having a wine glass seat on which to support the bowl of the wine glass, said wine glass seat having a slot formed therein through which to receive the stem of the wine glass, wherein said wine glass holder has a swivel arm having a first end pivotally coupled to said table and an opposite end connected to said wine glass seat, said swivel arm being rotatable relative to said table to correspondingly rotate said wine glass seat and the wine glass being held by said wine glass holder, and a push-button that is positioned to communicate with the second end of said swivel arm by way of a spring that is expanded to cause said swivel arm to be locked in place and thereby prevent the rotation of said swivel arm relative to said table, said push-button being responsive to a pushing force applied thereto to cause said spring to be compressed and thereby unlock said swivel arm and permit a rotation of said swivel arm and the wine glass held by said wine glass holder.

* * * * *